US005582022A

United States Patent [19]

Heinrichs et al.

[11] Patent Number: 5,582,022

[45] Date of Patent: Dec. 10, 1996

[54] ECONOMIZER CONTROL FOR TWO-STAGE COMPRESSOR SYSTEMS

[75] Inventors: Anton D. Heinrichs, Ransomville; Peter P. Narreau, Pennellville, both of N.Y.

[73] Assignee: Carrier Corporation, Syracuse, N.Y.

[21] Appl. No.: 443,508

[22] Filed: May 18, 1995

Related U.S. Application Data

[63] Continuation-in-part of Ser. No. 167,467, Dec. 14, 1993, abandoned.

[51] Int. Cl.[6] ..... F25B 31/00; F25B 7/00

[52] U.S. Cl. ..... 62/175; 62/203; 62/505

[58] Field of Search ..... 62/175, 505, 203

[56] References Cited

U.S. PATENT DOCUMENTS

| | | | |
|---|---|---|---|
| 3,859,815 | 1/1975 | Kasahara | 62/197 |
| 3,869,874 | 3/1975 | Ditzler | 62/278 |
| 4,245,476 | 1/1981 | Shaw | 62/2 |
| 4,833,893 | 5/1989 | Morita | 62/713 |
| 4,899,555 | 2/1990 | Shaw | 62/505 |
| 4,947,655 | 8/1990 | Shaw | 62/200 |
| 5,056,329 | 10/1991 | Wilkinson | 62/197 |

FOREIGN PATENT DOCUMENTS

| | | | |
|---|---|---|---|
| 2579305 | 9/1986 | France | 62/505 |
| 3339806A1 | 5/1985 | Germany . | |
| 0124354 | 10/1978 | Japan | 62/505 |

*Primary Examiner*—William E. Wayner

[57] ABSTRACT

In a refrigeration system having low and high stage compressors and a subcooler or economizer, economizer gas is selectively supplied to the compressor motors for cooling and to the suction of the high stage to increase capacity. By selectively controlling the delivery of the economizer gas, efficiency of the refrigeration system is increased.

6 Claims, 2 Drawing Sheets

| FIG.1A |
|---|
| FIG.1B |

ECONOMIZER CONTROL FOR TWO-STAGE COMPRESSOR SYSTEMS

This is a continuation-in-part of Application Ser. No. 08/167,467 filed Dec. 14, 1993, now abandoned.

BACKGROUND OF THE INVENTION

An economizer is normally employed to increase the capacity of refrigeration or air conditioning systems. The compressor discharge pressure varies seasonally and the saturated condensing temperature can drop too low. Under these circumstances the advantages of economizer operation is minimal. In two-stage compressor systems employing an economizer, injection normally takes place between the stages such that economizer gas mixes with the high stage suction gas supplied to the high stage. The economizer provides subcooling of the liquid and desuperheating of some vapor which results in a more efficient system. However, as the load requirements change, either only the high stage, or only the low stage may be used thereby obviating the benefits of supplying economizer gas to the suction of the high side.

SUMMARY OF THE INVENTION

A two-stage compressor system employing an economizer is operated to optimize the efficiency of the system. Depending upon operating conditions, the system can be operated in a number of ways: first, economizer operation for high stage motor cooling and single stage high temperature application; second, economizer gas is delivered to the suction of the high stage and liquid injection to cool the motors; and third, feed economizer gas through the low stage for motor cooling and single stage low temperature applications. Thus, utilizing compressors that have economizer ports on each stage of a two stage system permits the use of two additional locations for bringing economizer/subcooler flow back to the compressors. The three locations should be contrasted with the suction of the high stage being the only location in a standard two stage system. In a system using compressors with economizer ports according to the teachings of the present invention, the best location for economizer/subcooler flow injection will vary based on which compressors are running. For example, if the low stage is shut off, as because its load is satisfied as indicated by suction pressure, then the most efficient location would be the high stage economizer port. If the high stage is off, as due to seasonal loading or a satisfied load as would be indicated by space or air temperature and the microprocessor would shut off the evaporator if the load is met, then the low stage compressor could be run as a single stage compressor and use the low stage economizer port. If both stages are on then the ideal location is the conventional high stage suction. In each case, efficiency is maximized by running the least amount of compressors with the correct injection port to provide subcooling for the operating configuration at the most efficient location. Additionally, at low capacity operation, such as when only the high or low stage is required, all motor cooling may be accomplished through the economizer operation thereby negating any need for additional liquid injection. High temperature applications for the present invention, include such things as air conditioning and food coolers in grocery stores while low temperature applications include frozen food cases in grocery stores.

It is an object of this invention to optimize the efficiency of a two stage system.

It is another object of this invention to provide flexibility of operation and control. These objects, and others as will become apparent hereinafter, are accomplished by the present invention.

Basically, economizer operation of a two-stage system is controlled to achieve increased capacity, to optimize efficiency, and for motor cooling and/or discharge temperature control. Overall control is achieved by a microprocessor which receives pressure and temperature information from the refrigeration system and in response to the received information controls the compressors and flow in various parts of the refrigeration system to achieve economizer operation, motor cooling and/or discharge temperature control by providing economizer flow to the economizer of whichever one of the compressors is operating during single stage operation and to the inlet of the second stage during two stage operation. This results in running the minimum number of compressors at the lowest optimal interstage pressure. The liquid temperature is therefore optimized thereby increasing compressor capacity. Additionally, when either the high or low-stage is run individually the economizer flow which is then routed through its own economizer port provides motor cooling, reducing liquid injection requirements and thereby increasing compressor efficiency.

BRIEF DESCRIPTION OF THE DRAWING

For a fuller understanding of the present invention, reference should now be made to the following detailed description thereof taken in conjunction with the accompanying drawing wherein.

DESCRIPTION OF THE PREFERRED EMBODIMENT

Figures 1, 1B:
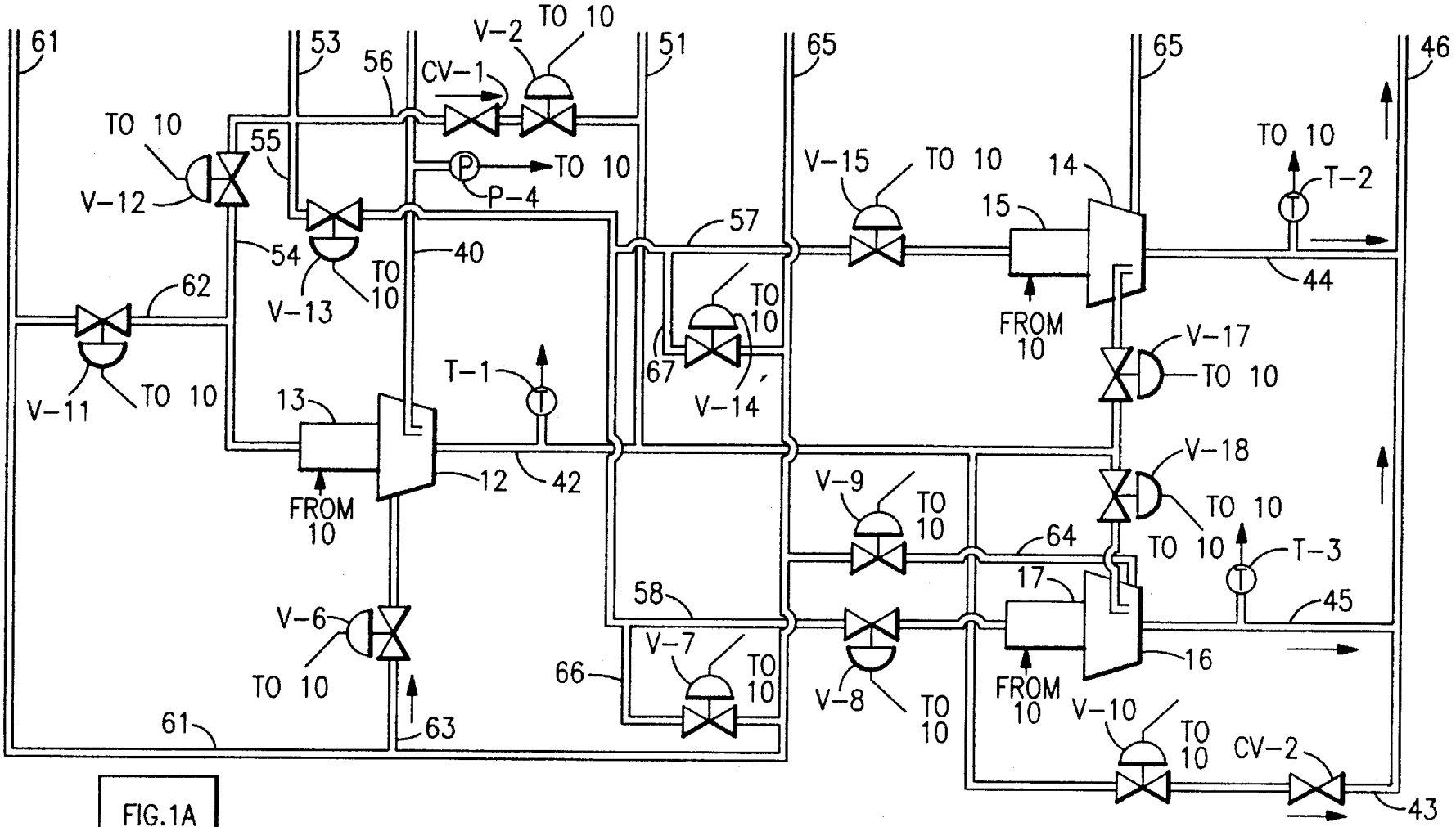
FIG. 1 shows the arrangement of FIGS. 1A and 1B.
FIGS. 1A and 1B make up a schematic drawing of a two-stage compressor system in a refrigeration system employing an economizer.
Figure 1A:
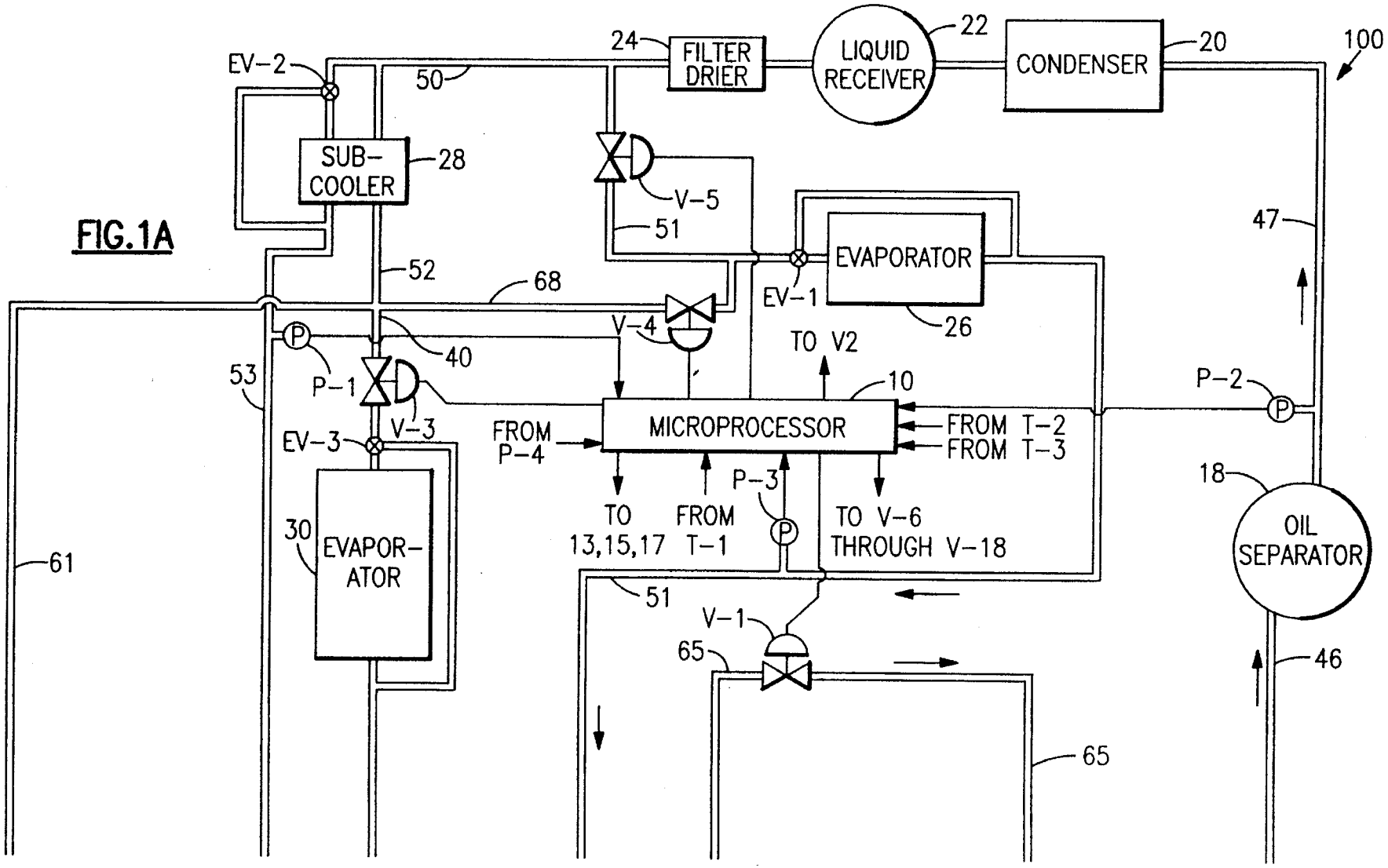

In the Figure, the numeral 100 generally indicates a refrigeration system controlled by microprocessor 10. The refrigeration system 100 includes a low stage or booster screw compressor 12 with a motor 13 and high stage screw compressors 14 and 16 with motors 15 and 17, respectively. The microprocessor 10 will control motors 13, 15 and 17 and thereby compressors 12, 14 and 16, respectively, responsive to sensed inputs as indicated by suction pressure, space or air temperature, and/or seasonal requirements such that the proper compressor(s) is operated based upon system demand. Additionally, capacity, motor cooling and thereby the efficiency of the system will be controlled through appropriate economizer operation and motor cooling for the operating conditions and demand. The high stage compressors 14 and 16 discharge into a line serially including oil separator 18, condenser 20, liquid receiver 22 and filter drier 24. The output of filter drier 24 is supplied to evaporator(s) 26 which has a high temperature refrigeration load such as that represented by the air conditioning and/or the food coolers in a supermarket and/or to subcooler 28. Economizer gas from subcooler or economizer 28 is supplied to compressors 14 and 16 via the suction headers while liquid refrigerant is supplied to evaporator 30 which has a low temperature refrigeration load and/or to the compressors.

Microprocessor 10 receives temperature information from temperature sensors T-1 to T-3 so as to control injection for cooling the motors, and pressure information from pressure sensors P-1 to P-4 which indicates whether or not the load is satisfied. Responsive to the pressure and temperature information, microprocessor 10 controls motors 13, 15 and 17 and, thereby, compressors 12, 14 and 16. Additionally, microprocessor 10 controls the operation of refrigeration system 100 through valves V-1 to V-18 thereby directing flow in the proper flow path for the sensed conditions. Valves V-1 to V-18 are solenoid valves and may be operated in an on-off or pulsed fashion. Where valves in a flow path are in series, only one valve will be regulated with the other valve(s) being open during flow conditions.

The evaporator 30 is connected to the suction port of compressor 12 via line 40. Compressor 12 discharges into line 42 with the compressor discharge temperature being sensed by temperature sensor T-1 so that liquid injection can be controlled. If compressor 12 is shut off, but compressor 14 and/or 16 is running, valve V-3 will be closed and an internal check valve will prevent reverse flow through compressor 12. Line 42 is connected to the suction ports of compressors 14 and 16. Compressor 14 discharges into line 46 via line 44 with the compressor discharge temperature being sensed by temperature sensor T-2. Similarly, compressor 16 discharges into line 46 via line 45 with the compressor discharge temperature being sensed by temperature sensor T-3. When compressors 14 and 16 are shut off and compressor 12 is running, valves V-17 and V-18 are closed and compressors 14 and 16 are bypassed via line 43 which contains solenoid valve V-10 and check valve CV-2.

All of the discharge flow from compressors 12, 14 and 16 is supplied to line 46 where the flow is supplied to oil separator 18. In oil separator 18 oil is removed from the refrigerant gas and subsequently returned to the compressors. The separated refrigerant passes from oil separator 18 via line 47 to condenser 20. Pressure sensor P-2 senses the pressure of the gaseous refrigerant in line 47. In condenser 20 the hot, high pressure gaseous refrigerant is condensed. The condensed refrigerant serially passes through liquid receiver 22 and filter drier 24 into line 50. Flow from line 50 can take any one of three branches 51 through 53. Line 51 extends between lines 50 and 42 and serially includes solenoid valve V-5, expansion valve EV-1 which is controlled responsive to the superheat of the refrigerant leaving evaporator 26, and evaporator 26. Pressure sensor P-3 senses the pressure of the refrigerant in line 51 downstream of evaporator 26 which represents the suction pressure of compressors 14 and 16. Line 53 extends between line 50 and the intersection of line 53 with lines 54, 55 and 56 and serially includes expansion valve EV-2 which is controlled responsive to the superheat of the gaseous refrigerant, economizer gas, exiting subcooler 28 via line 53 and subcooler 28. Line 54 contains solenoid valve V-12 and supplies cooling flow to the motor 13. The motor cooling flow from line 54 supplements the suction flow supplied to compressor 12 via line 40 since it mixes with the gas being compressed. Line 55 contains solenoid valve V-13 and branches into lines 57 and 58 containing solenoid valves V-15 and V-8, respectively, and supply cooling flow to motors 15 and 17, respectively. The motor cooling flow from lines 57 and 58 supplements the suction flow supplied to compressors 14 and 16, via line 42 and valves V-17 and V-18, respectively, since it mixes with the gas being compressed. Line 56 connects the flow from line 53 with line 51 and serially contains check valve CV-1 and solenoid valve V-2. Accordingly, flow through line 56 is supplied via lines 51 and 42 to the suction ports of compressors 14 and 16.

Line 52 provides liquid refrigerant to a number of lines. Line 61 receives liquid refrigerant from line 52 and delivers it to branch lines 62 through 67. Line 62 connects lines 61 and 54 and contains solenoid valve V-11. Line 62 delivers refrigerant to line 54 for cooling motor 13. Line 63 contains solenoid valve V-6 and delivers liquid refrigerant for injection into compressor 12 to control the discharge gas temperature in line 42 which is sensed by thermal sensor T-1. Line 64 contains solenoid valve V-9 and delivers liquid refrigerant for injection into compressor 16 to control the discharge gas temperature in line 45 which is sensed by thermal sensor T-3. Line 65 contains solenoid valve V-1 and delivers liquid refrigerant for injection into compressor 14 to control the discharge gas temperature in line 44 which is sensed by thermal sensor T-2. Line 66 contains solenoid valve V-7 and connects lines 61 and 58 for providing liquid refrigerant for cooling motor 17. Line 67 contains solenoid valve V-14 and connects lines 61 and 57 for providing liquid refrigerant for cooling motor 15. Line 52 supplies liquid refrigerant to line 68 which contains solenoid valve V-4 and connects to line 51 for supplying liquid refrigerant to evaporator 26. Line 52 supplies liquid refrigerant to line 40. Line 40 extends between line 52 and the suction port of compressor 12 and serially contains solenoid valve V-3, expansion valve EV-3 which is controlled responsive to the superheat of refrigerant leaving evaporator 30, evaporator 30 and pressure sensor P-4 which senses the pressure of the refrigerant in line 40 which is supplied to the suction port of compressor 12.

From the foregoing description it should be clear that microprocessor 10 receives inputs indicative of the discharge temperatures of compressors 12, 14 and 16 from temperature sensors T-1 to T-3, and inputs indicative of the suction pressures of compressors 12, 14 and 16 and the discharge pressure of the refrigerant delivered to the condenser 20 from pressure sensors P-1 to P-4. Responsive to the temperature and pressure inputs, microprocessor 10 controls motors 13, 15 and 17, and thereby compressors 12, 14 and 16, and valves V-1 to V-18. Basic compressor operation is responsive to suction pressure and the capacity requirements indicated thereby dictate which compressor or combination of compressors is operated. This, in turn, dictates the requirements for motor cooling, economizer operation, and discharge temperature control. Evaporators 26 and 30 are usually controlled locally rather than through microprocessor 10.

In operation, all three compressors 12, 14 and 16 may be operating or only one of them, compressor 12 may be shut off with both of compressors 14 and 16 operating, or compressor 12 may operate with only one of compressors 14 and 16 operating. Liquid refrigerant for cooling motor 13 is controlled via valve V-11, while liquid refrigerant for cooling motor 15 is controlled via valve V-14 and liquid refrigerant for cooling motor 17 is controlled via valve V-7. Economizer gas for cooling low stage motor 13 and single stage low temperature applications is supplied by subcooler or economizer 28 by connecting lines 53 and 54 and controlling valve V-12. Economizer gas for cooling high stage motors 15 and/or 17 and for single stage high temperature applications is supplied by subcooler or economizer 28 by connecting lines 53 and 55 and controlling valve V-13 as well as valve V-15 to cool high stage motor 15 and valve V-8 to cool high stage motor 17. Economizer gas for booster operation is supplied to the high stage suction port(s) by connecting line 53 to line 56 which is connected to line 42 which feeds the suction ports of high stage compressors 14 and 16 and controlling valve V-2 in line 56.

Although a preferred embodiment of the present invention has been illustrated and described, other changes will occur to those skilled in the art. For example, the microprocessor may control the system responsive to thermostatic inputs associated with the regions cooled by evaporators 26 and 30. Also, although screw compressors have been disclosed, the present invention applies to other positive displacement compressors. It is therefore intended that the scope of the present invention is to be limited only by the scope of the appended claims.

What is claimed is:

1. In a refrigeration system including a low stage compressor and motor means, high stage compressor and motor means, condenser means, economizer means and evaporator means, control means comprising:

means for sensing parameters indicative of operating conditions in said refrigeration system; and means for selectively supplying economizer gas to said low stage motor means, to said high stage motor means, to said high stage compressor means responsive to parameters sensed by said means for sensing parameters so as to optimize efficiency of said refrigeration system and to cool said low and high stage motor means.

2. The control means of claim 1 wherein said means for sensing parameters includes means for sensing discharge temperatures for said low and high stage compressor means and means for sensing suction pressure for said low and high stage compressor means.

3. The control means of claim 1 wherein said means for selectively supplying economizer gas include valve means for selectively directing economizer gas to said low stage motor means, said high stage motor means or to said high stage compressor.

4. The control means of claim 1 further including means for controlling said low and high stage motor means.

5. A method of operating a refrigeration system having a low stage compressor and motor means, high stage compressor and motor means, condenser means, economizer means and evaporator means comprising the steps of:

sensing parameters indicative of operating conditions in said refrigeration system; and selectively supplying economizer gas to said low stage motor means, said high stage motor means, to said high stage compressor means whereby, as required, said low stage motor means and said high stage motor means are cooled and said high stage compressor means is increased in capacity.

6. The method of claim 5 wherein said step of sensing parameters includes:

sensing discharge temperatures for said low and high stage compressor means; and sensing suction pressure for said low and high stage compressor means.

* * * * *